US008728569B2

(12) United States Patent
Kripzak et al.

(10) Patent No.: US 8,728,569 B2
(45) Date of Patent: May 20, 2014

(54) METHOD FOR RECONDITIONING THE WORN SURFACE OF GRINDING ROLLERS OF A HIGH-COMPRESSION ROLLER MILL

(76) Inventors: Bernd Kripzak, Oelde (DE); Herbert Pingel, Wadersloh (DE)

( * ) Notice: Subject to any disclaimer, the term of this patent is extended or adjusted under 35 U.S.C. 154(b) by 0 days.

(21) Appl. No.: 13/580,709

(22) PCT Filed: Mar. 3, 2011

(86) PCT No.: PCT/EP2011/053169

§ 371 (c)(1),
(2), (4) Date: Aug. 23, 2012

(87) PCT Pub. No.: WO2011/107538

PCT Pub. Date: Sep. 9, 2011

(65) Prior Publication Data

US 2012/0315385 A1 Dec. 13, 2012

(30) Foreign Application Priority Data

Mar. 5, 2010 (DE) ..... 10 2010 010 431

(51) Int. Cl.
*B05D 3/12* (2006.01)

(52) U.S. Cl.
USPC ..... 427/140; 427/142

(58) Field of Classification Search
CPC ..... B32B 43/00; B32B 43/003; B05D 3/00; B05D 3/12
USPC ..... 427/140, 142
See application file for complete search history.

(56) References Cited

U.S. PATENT DOCUMENTS

| | | | | |
|---|---|---|---|---|
| 4,050,196 | A | 9/1977 | Theurer | |
| 4,996,757 | A * | 3/1991 | Parham | 29/402.18 |
| 6,357,683 | B1 * | 3/2002 | Patzelt et al. | 241/235 |
| 7,946,518 | B2 | 5/2011 | Patzelt et al. | |
| 2007/0187537 | A1 | 8/2007 | Batterham | |
| 2009/0178280 | A1 | 7/2009 | Patzelt et al. | |
| 2010/0058570 | A1 * | 3/2010 | Patzelt et al. | 29/402.06 |

FOREIGN PATENT DOCUMENTS

| | | | |
|---|---|---|---|
| DE | 4402958 | A1 | 10/1995 |
| DE | 102005004036 | B4 | 11/2006 |
| WO | WO 2008110224 | A1 * | 9/2008 |

* cited by examiner

*Primary Examiner* — Dah-Wei D Yuan
*Assistant Examiner* — Nga Leung V Law
(74) *Attorney, Agent, or Firm* — Renner Kenner Greive Bobak Taylor & Weber

(57) ABSTRACT

The method according to the invention for reprocessing the worn surface of grinding rollers (2) of a material bed roller mill comprises the following method steps: a. providing a mobile processing station (6) which is arranged in a container (8) and comprises at least one machine tool (9) and a drive (10) for rotating the grinding roller, b. removing the complete roller unit (A) containing the grinding roller to be reprocessed from the material bed roller mill, c. positioning the complete roller unit in front on the mobile processing station and coupling the drive to the shaft (1) of the grinding roller, d. producing a new cylindrical surface (2*h*) using the machine tool, and e. producing a new wear protection comprising new profiled bodies (2*c*) and/or build-up welding.

8 Claims, 6 Drawing Sheets

METHOD FOR RECONDITIONING THE WORN SURFACE OF GRINDING ROLLERS OF A HIGH-COMPRESSION ROLLER MILL

The invention relates to a method for reconditioning the ground surface of grinding rollers of a high-compression roller mill.

High-compression roller mills have been known for 30 years and continue to provide an energy-efficient comminution process for fragmented materials, such as in particular limestone. A high-compression roller mill consists of two roller units, each of which comprises a grinding roller mounted on a shaft, bearings provided on both sides of the grinding roller, and associated bearing jewels. Two of these roller units are so oriented that a given roll gap is formed between two opposing rollers. The two rollers are driven in opposite directions and are pressed against one another with high pressures of at least 50 MPa.

Because of the high load, the surfaces of the grinding rollers of such high-compression roller mills are subject to high wear. Various wear protection concepts are therefore used, the most common measures including build-up welding and the fitting of protruding profiled bodies.

Conventional roller units have a roller diameter in the range of from 1.5 to 3 m and have a weight of up to 120 tonnes. According to the current state of technology, grinding rollers must be reconditioned in a service centre or a workshop after a specific operating period. Such reconditioning methods are described in greater detail, for example, in DE 10 2006 028 546 A1, DE 10 2007 018 090 A1 and DE 10 2007 012 102 A1.

The costs for reconditioning are approximately in the range of from 60 to 80% of the price when new. Added to this are the not inconsiderable costs of transporting the grinding rollers to a service centre or an appropriately equipped workshop. A further drawback are the downtimes, which in some cases are long.

From DE 44 02 958 A1, DE 26 12 173 B, DE 10 2005 004 036 B4 and DE 26 12 173 B there are known "on site" repairs, where the necessary tools are brought to the tool.

Accordingly, the object underlying the invention is to reduce the costs of reconditioning the worn surface of grinding rollers of a high-compression roller mill.

According to the invention, the object is achieved by the features of claim 1.

The method according to the invention for reconditioning the worn surface of grinding rollers of a high-compression roller mill comprises the following steps:

a. providing a mobile processing station which is arranged in a container and has at least one cutting machine tool and a drive for rotating the grinding roller,
b. removing the complete roller unit with the grinding roller that is to be reconditioned from the high-compression roller mill,
c. positioning the complete roller unit in front of the mobile processing station and coupling the drive to the shaft of the grinding roller,
d. producing a new cylindrical surface by means of the cutting machine tool, and
e. producing new wear protection with new profiled bodies and/or with build-up welding.

By providing a mobile processing station arranged in a container it is possible to recondition the worn surfaces of grinding rollers on site. As a result, considerable transport costs can be saved on the one hand; in addition, reconditioning is possible in a considerably shorter time because transport times are eliminated. If the service centre was located in a neighbouring country, considerable further costs were sometimes also incurred as a result of customs formalities, and these are now eliminated.

A mobile processing station arranged in a container can be accommodated, for example, on the trailer of a lorry. Because the service lives can be predicted relatively accurately for each high-compression roller mill, the mobile processing station can be brought to high-compression roller mills located at different sites according to a given time schedule.

In order to keep the processing station as compact as possible, bearings for mounting the grinding rollers, which are otherwise conventional in service centres, have been omitted. Instead, it is provided that the complete roller unit with the grinding roller that is to be reconditioned is removed from the high-compression roller mill and positioned directly in front of the mobile processing station. The grinding roller is accordingly mounted in its own bearings during conditioning. Since the grinding roller does not have to be accommodated in the container, the dimensions of the container can be correspondingly smaller.

Conditioning of the grinding rollers on site further allows the downtimes of the high-compression roller mill to be reduced to a minimum.

Further embodiments of the invention are the subject of the dependent claims.

If the grinding rollers are provided with a plurality of profiled bodies which are inserted with a portion of their length in bores in a roller body and protrude with the remaining portion of their length beyond the surface of the roller body, the protruding portion of the profiled bodies and the surface of the roller body can become worn at least partially. In that case, the reconditioning method comprises the following further steps:

a. removing the worn profiled bodies before the new cylindrical surface is produced,
b. drilling new bores for new profiled bodies after the new cylindrical surface has been produced, and
c. inserting new profiled bodies into the bores.

If, on the other hand, the grinding rollers are provided with build-up welding as wear protection, the new cylindrical surface is armoured again by build-up welding during conditioning. To that end, in particular a plurality of weld layers is applied.

For that purpose, the mobile processing station has a welding device, so that a layer of material for increasing the diameter and/or for armouring can be welded onto the new cylindrical surface prior to drilling. The processing station further comprises a drive which rotates the grinding roller during production of the new cylindrical surface.

The production of the new cylindrical surface can be carried out by milling or another cutting machining process. In the case of milling there is advantageously employed a milling head which is used with a radial orientation with respect to the grinding roller.

Depending upon the configuration of the grinding rollers, any lateral wear protection and/or edge wear protection that may be present must be removed before the new cylindrical surface is produced.

The mobile processing station for carrying out the above method has at least one cutting machine tool and a drive for rotating the grinding roller, which are arranged in the container. The cutting machine tool can be formed, for example, by a drilling machine, a grinding machine, a lathe or a robot. A device for supplying coolant and/or lubricant and optionally means for collecting and recycling excess coolant and/or lubricant can further be provided in the container. It is also possible to provide in the container a control platform for controlling the cutting machine tool and the drive.

Further advantages and embodiments of the invention are explained in detail below by means of the description and the drawings, in which.

Figure 3:
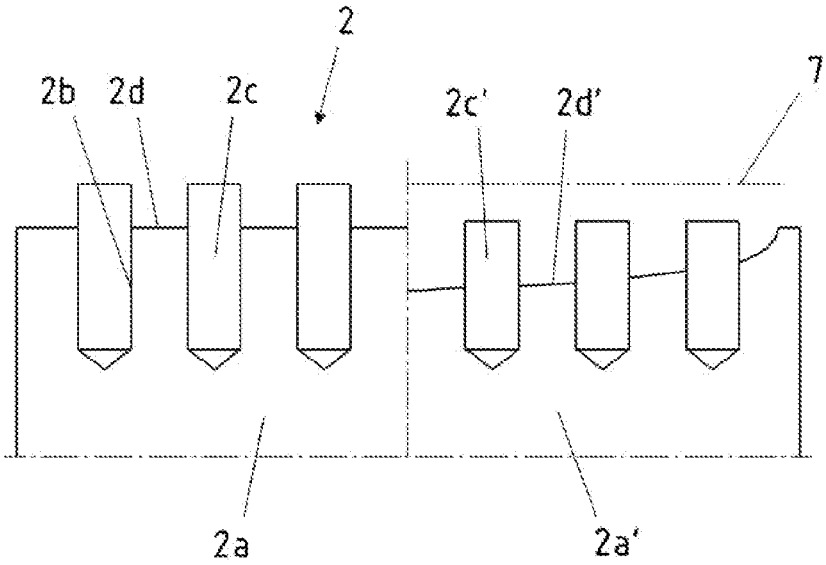
Figure 4:
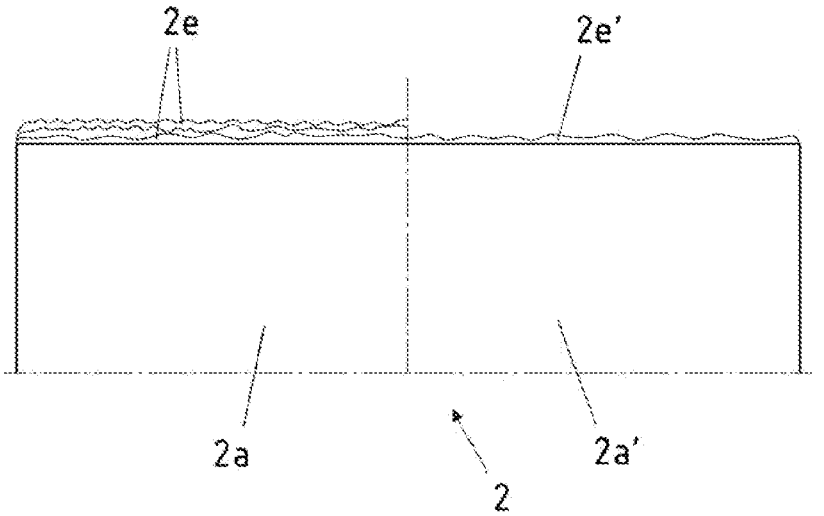
Figure 5:
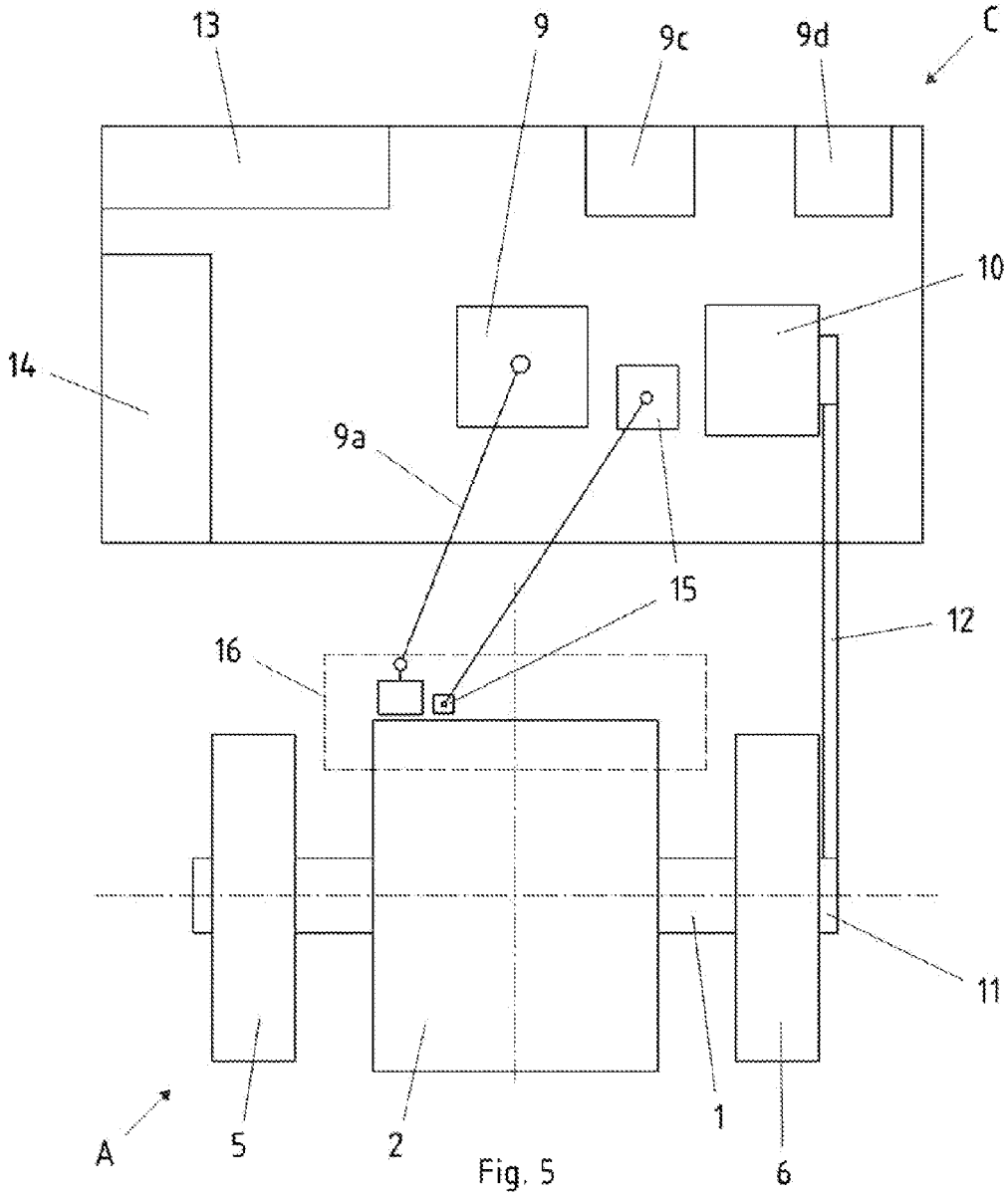
Figure 6:
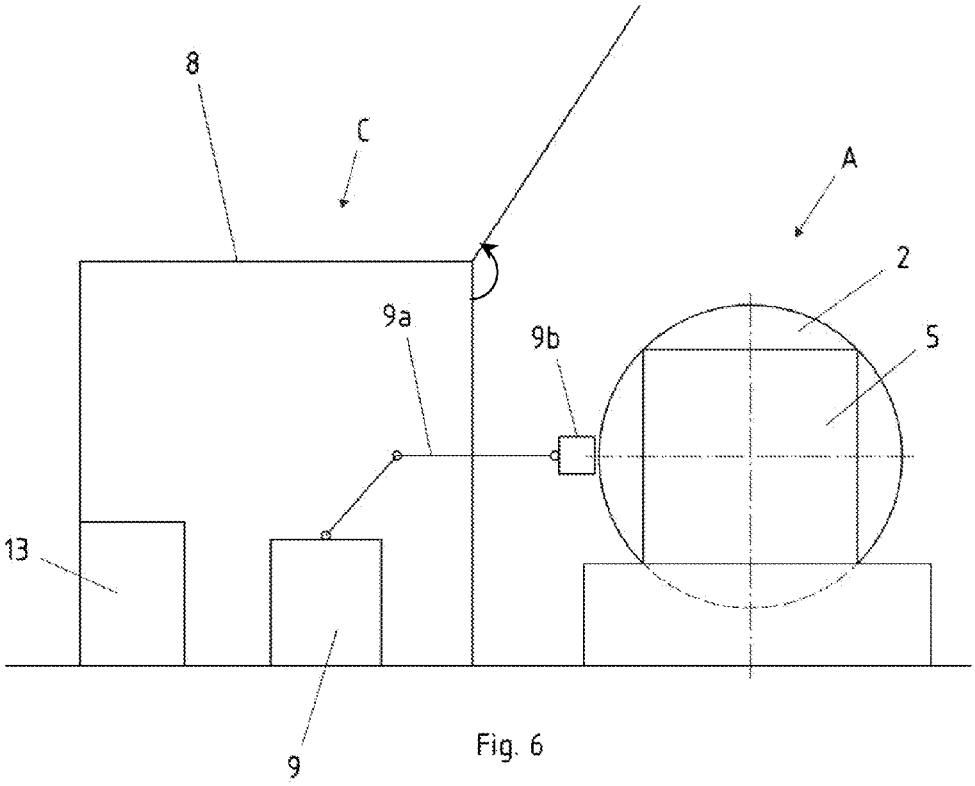

FIG. 3 shows a schematic view of a roller mill with profiled bodies in the new state and in the worn state, FIG. 4 shows a schematic view of a roller mill with build-up welding in the new state and in the worn state, FIG. 5 shows a top view of the mobile processing station and of a roller unit during conditioning of the grinding roller, FIG. 6 shows a side view of the mobile processing station and of the roller unit according to FIG. 5, and FIGS. 7*a* to 7*f* show schematic views of the grinding roller at various stages of the conditioning.

Figure 2:
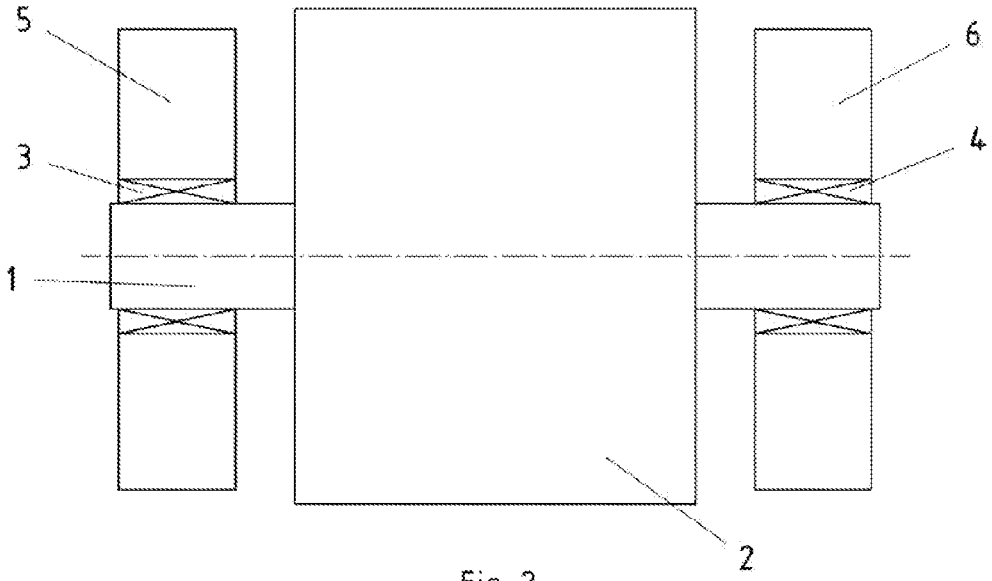
FIG. 2 shows a schematic view in longitudinal section of a roller unit.
Figure 1:
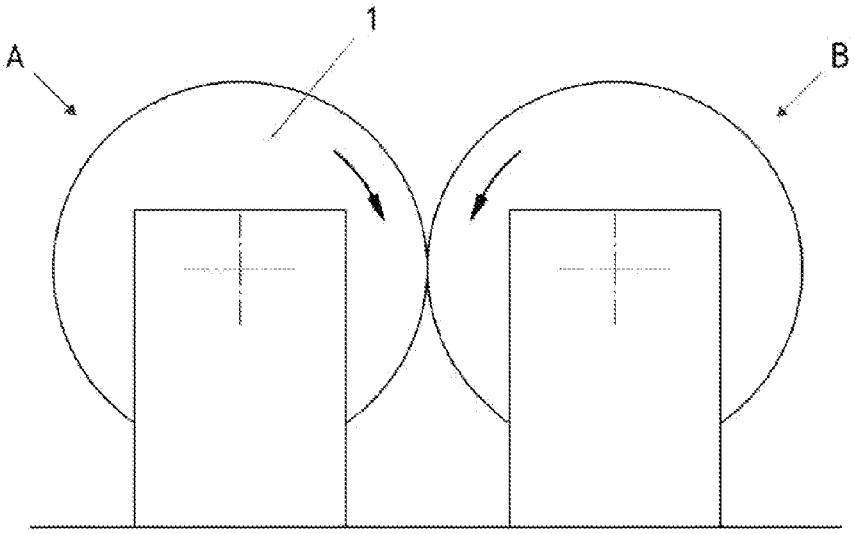
FIG. 1 shows a schematic side view of a high-compression roller mill.

The high-compression roller mill shown in FIG. 1 consists of two roller units A and B. In FIG. 2, one of the roller units is shown in slightly more detail in a view in longitudinal section. It has a grinding roller 2 mounted on a shaft 1, bearings 3, 4 provided on both sides of the grinding roller, and associated bearing jewels 5, 6.

The two rollers are driven in opposite directions and are pressed against one another during operation with a pressure of more than 50 MPa, there being maintained a given gap, into which the material for grinding is drawn.

FIG. 3 shows (in a schematic partial longitudinal section through the grinding roller 2), on the left-hand side, the new state of the grinding roller 2, which has a roller body 2*a* provided with a plurality of bores 2*b* into which profiled bodies 2*c* are inserted with a portion of their length, while they protrude with the remaining portion of their length beyond the surface 2*d* of the roller body 2*a*.

On the right-hand side, the worn state after a certain operating period is shown. The surface 2*d*' of the roller body 2*a*' is worn to a greater or lesser extent—by different amounts in the individual regions. Likewise, the profiled bodies 2*c*' have been shortened by wear as compared with their original length (level line 7).

The grinding roller 2 shown in FIG. 4 is provided in the new state shown on the left-hand side with a plurality of build-up weld layers 2*e* as wear protection. On the right-hand side of FIG. 4, the worn state of the build-up weld layers 2*e*' is shown.

FIGS. 5 and 6 show a mobile processing station C during the reconditioning of the roller unit A. The mobile processing station C has in particular a container 8, in which there is provided at least one cutting machine tool 9, which is preferably a robot having a pivot arm 9*a*, which is pivotable and rotatable about several axes, and a machining tool 9*b*. There is further provided in the container a drive 10 for rotating the grinding roller 2. To that end, for example, a chain wheel 11 is screwed to one end of the shaft 1 of the roller unit A, which chain wheel 11 is connected with the drive 10 by way of a drive chain 12. A rotary movement can be transmitted to the shaft 1 by the drive. There is advantageously provided on the drive 10 a measuring device, which allows accurate positioning of the rotational position of the grinding roller 2.

There are further present in the container a control platform 13 for controlling the machine tool 9 and the drive 10, a magazine 14 for new profiled bodies, and storage areas for various machining tools 9*c*, 9*d*, for example a drilling head and a welding device.

In the exemplary embodiment shown, there is further provided in the container C a device 15 for supplying coolant and/or lubricant. Means 16 for collecting and recycling excess coolant and/or lubricant are also provided.

The container C is further so configured that the longitudinal side opposite the roller unit can be lifted up (see FIG. 6). It is naturally also conceivable that part of or the entire cover of the container can also be opened.

The roller unit A to be conditioned is positioned immediately in front of the processing station C, so that the grinding roller is within reach of the machine tool 9. The particular feature is that the complete roller unit is oriented in front of the mobile processing station so that the grinding roller is able to rotate in its own bearings. After the grinding roller has been oriented in relation to the machine tool 9, the reconditioning can begin, which is explained in detail with reference to FIGS. 7*a* to 7*f*.

Figure 7A:
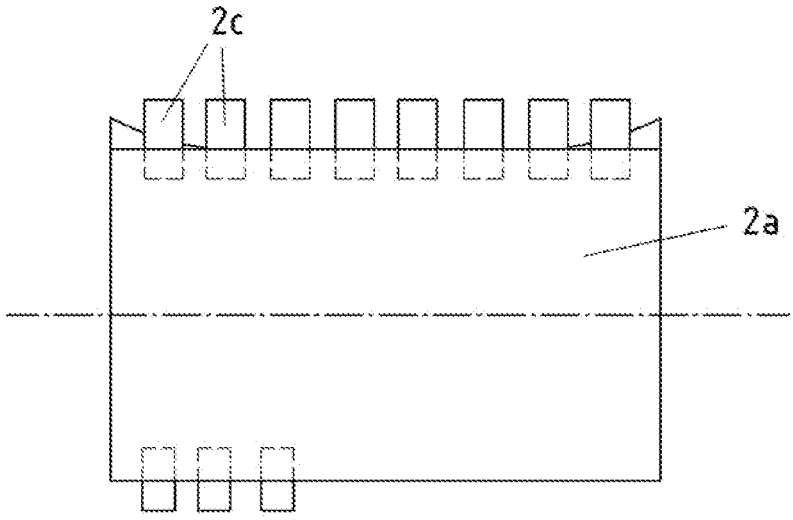
Figure 7B:
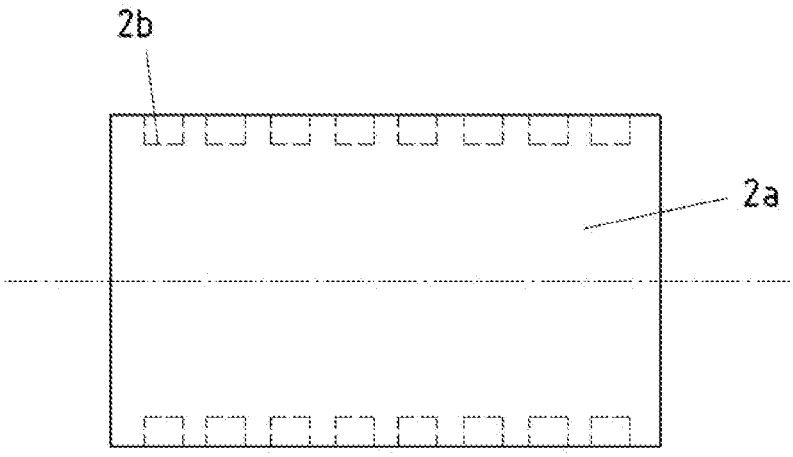
Figure 7C:
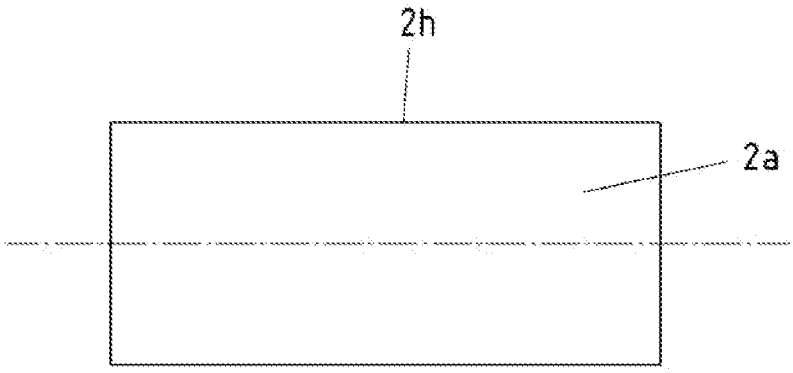

FIG. 7*a* shows a worn grinding roller, the wear protection of which was formed by profiled bodies 2*c*. In a first step, the old profiled bodies 2*c* are removed (FIG. 7*b*). Then a new cylindrical surface 2*h* is produced by means of the machine tool 9. There is employed as the machining tool 9*b*, for example, a milling head, which is used with a radial orientation with respect to the grinding roller. The surface of the grinding roller is removed until all the bores 2*b* have disappeared completely (FIG. 7*c*).

Figure 7D:
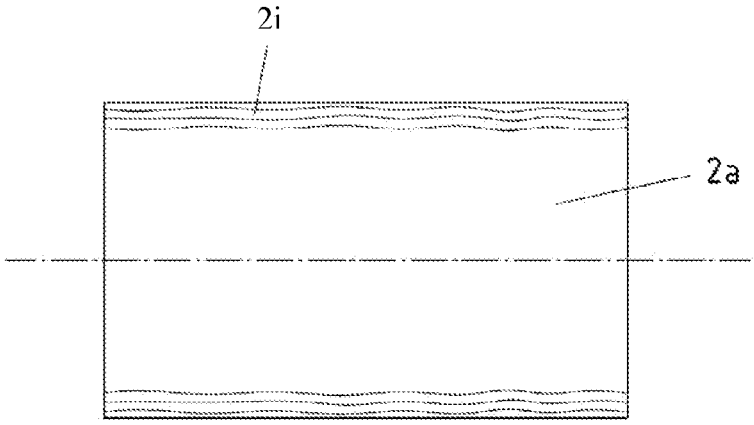
Figure 7E:
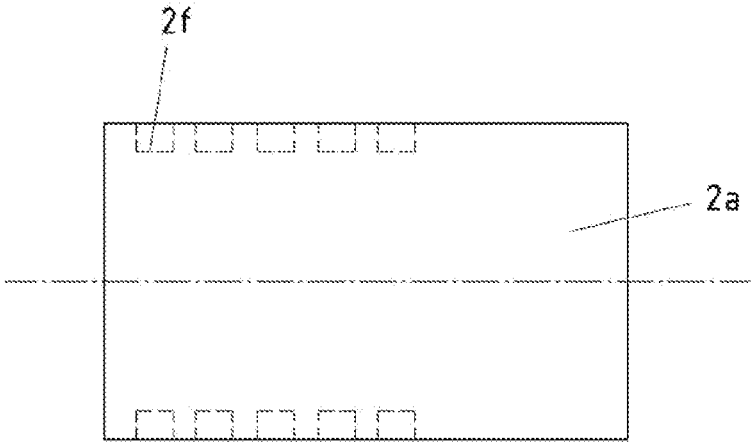
Figure 7F:
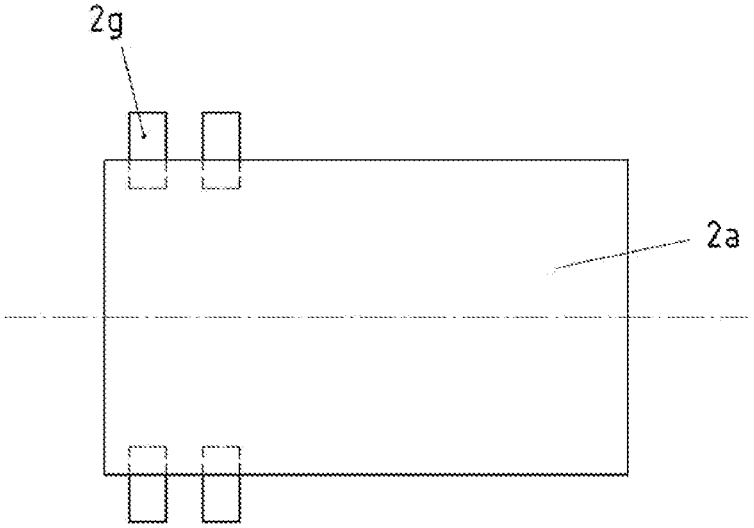

If the mobile processing station C has a welding device, or the machine tool 9 has a welding head 9*d*, it is possible to weld layers of material 2*i* for increasing the diameter onto the new cylindrical surface (FIG. 7*d*).

New bores 2*f* can then be drilled into the new cylindrical surface 2*h*, or into the material layers 2*i*, by means of a drilling head. It is important to maintain a given pattern of holes in dependence upon the diameter of the grinding roller. Correct positioning is obtained by suitably controlling the machine tool 9 and the drive 10.

Once all the bores 2*f* have been drilled, they can be fitted with new profiled bodies 2*g*.

By reconditioning the grinding roller in the immediate vicinity of the high-compression roller mill, the downtimes of the high-compression roller mill can be reduced to a minimum, because long transport times to and from service centres are eliminated. Although the mobile processing station has to be transported to grinding rollers that are in use and are to be conditioned, the transport costs are many times lower because a mobile processing station has only about one tenth the weight of a grinding roller. The mobile processing station can in particular be accommodated in a container, which has a weight of approximately from 10 to 12 tonnes.

The invention claimed is:

1. Method for reconditioning the worn surface of grinding rollers of a high-compression roller mill, wherein a complete roller unit includes the grinding roller mounted on a shaft, bearings provided on both sides of the grinding roller, and associated bearing jewels, and the grinding rollers are provided with wear protection formed by profiled bodies or build-up welding, characterised by the following steps:

a. providing a mobile processing station which is arranged in a container and has at least one cutting machine tool and a drive for rotating the grinding roller, b. removing the complete roller unit with the grinding roller that is to be reconditioned from the high-compression roller mill, c. positioning the complete roller unit in front of and outside of the container of the mobile processing station and coupling the drive to the shaft of the grinding roller such that the grinding roller rotates on its own bearings during steps d and e below, d. producing a new cylindrical surface on the grinding roller by means of the cutting machine tool, and e. producing new wear protection on the grinding roller with either new profiled bodies or build-up welding or both.

2. Method according to claim 1, characterised in that the grinding rollers have a plurality of profiled bodies which are inserted with a portion of their length into bores of a roller body and protrude with the remaining portion of their length beyond the surface of the roller body, wherein the protruding portion of the profiled bodies and the surface of the roller body is at least partially worn, wherein the reconditioning method comprises the following further steps:

a. removing the worn profiled bodies before the new cylindrical surface is produced, b. drilling new bores for new profiled bodies after the new cylindrical surface has been produced, and c. inserting new profiled bodies into the bores.

3. Method according to claim 1, characterised in that the grinding rollers are provided with build-up welding as wear protection, and the new cylindrical surface is armoured again by build-up welding during reconditioning.

4. Method according to claim 1, characterised in that a welding device is provided in the mobile processing station, and a layer of material for either increasing the diameter or for armouring or both is welded onto the new cylindrical surface prior to drilling.

5. Method according to claim 1, characterised in that the grinding roller is rotated by means of the drive during production of the new cylindrical surface.

6. Method according to claim 1, characterised in that the new cylindrical surface is produced by milling or other cutting machining processes.

7. Method according to claim 6, characterised in that there is employed for the milling a milling head which is used with a radial orientation with respect to the grinding roller.

8. Method according to claim 1, characterised in that any lateral wear protection and/or edge wear protection present on the grinding roller is removed before the new cylindrical surface is produced.

* * * * *